US008435108B2

(12) United States Patent
Denton et al.

(10) Patent No.: US 8,435,108 B2
(45) Date of Patent: May 7, 2013

(54) LOTTERY GAME APPARATUS INCLUDING THE ACCUMULATION OF PLAYER POINTS

(75) Inventors: Lori Ericka Denton, Silver Spring, MD (US); Lyle Scrymgeour, Oakbank (CA); Nancy Bettcher, Winnipeg (CA)

(73) Assignee: Pollard Banknote Limited Partnership, Winnipeg, MB (CA)

( * ) Notice: Subject to any disclaimer, the term of this patent is extended or adjusted under 35 U.S.C. 154(b) by 0 days.

(21) Appl. No.: 13/304,557

(22) Filed: Nov. 25, 2011

(65) Prior Publication Data

US 2012/0302309 A1 Nov. 29, 2012

Related U.S. Application Data

(63) Continuation-in-part of application No. 12/783,791, filed on May 20, 2010.

(60) Provisional application No. 61/512,262, filed on Jul. 27, 2011, provisional application No. 61/451,403, filed on Mar. 10, 2011, provisional application No. 61/451,392, filed on Mar. 10, 2011, provisional application No. 61/437,444, filed on Jan. 28, 2011, provisional application No. 61/180,968, filed on May 26, 2009.

(51) Int. Cl.
*A63F 9/24* (2006.01)
*A63F 13/00* (2006.01)

(52) U.S. Cl.
USPC ..... 463/17

(58) Field of Classification Search ..... 463/16–20, 463/25, 29, 40–42
See application file for complete search history.

(56) References Cited

U.S. PATENT DOCUMENTS

| | | | | |
|---|---|---|---|---|
| 2001/0033689 | A1 | 10/2001 | Meder | |
| 2001/0049305 | A1* | 12/2001 | Riendeau et al. | 463/42 |
| 2003/0045340 | A1* | 3/2003 | Roberts | 463/17 |
| 2004/0176158 | A1* | 9/2004 | Baldwin | 463/17 |
| 2004/0204222 | A1* | 10/2004 | Roberts | 463/17 |
| 2004/0229677 | A1* | 11/2004 | Gray et al. | 463/17 |
| 2005/0149393 | A1* | 7/2005 | Leof | 705/14 |
| 2005/0197968 | A1* | 9/2005 | Das et al. | 705/64 |
| 2006/0025222 | A1* | 2/2006 | Sekine | 463/42 |
| 2006/0172799 | A1* | 8/2006 | Kane et al. | 463/25 |

(Continued)

FOREIGN PATENT DOCUMENTS

| | | | |
|---|---|---|---|
| EP | 1622104 | A2 | 2/2006 |
| JP | 2004227547 | | 8/2004 |

(Continued)

*Primary Examiner* — Milap Shah
(74) *Attorney, Agent, or Firm* — Adrian D. Battison; Ade & Company Inc.

(57) ABSTRACT

A lottery game apparatus includes a set of lottery tickets each printed with an instant win game and information defining a number of points awarded to the player in addition to or as an alternative to a prize for the game together with a programmed computer providing access to a web site associated with the set of tickets. The computer program provides communication through the internet for the player, and program components for registration of details of the player entering the web site and for storing data identifying each player for entry by the registered player of a points entry number from a played ticket so as to define for each player an account of a points total held by that player and a plurality of games to be played by the player using the points.

21 Claims, 3 Drawing Sheets

U.S. PATENT DOCUMENTS

| | | | | |
|---|---|---|---|---|
| 2007/0026926 | A1* | 2/2007 | Romanik | 463/17 |
| 2007/0117609 | A1* | 5/2007 | White et al. | 463/17 |
| 2007/0218980 | A1* | 9/2007 | Pachnis et al. | 463/25 |
| 2007/0238505 | A1 | 10/2007 | Okada | |
| 2008/0045299 | A1* | 2/2008 | Bennett et al. | 463/17 |
| 2008/0174068 | A1* | 7/2008 | York et al. | 273/139 |
| 2008/0220840 | A1 | 9/2008 | Katz et al. | |
| 2009/0023490 | A1* | 1/2009 | Moshal et al. | 463/17 |
| 2009/0042631 | A1* | 2/2009 | Randhawa | 463/17 |
| 2009/0061980 | A1* | 3/2009 | Holton et al. | 463/17 |
| 2009/0197662 | A1* | 8/2009 | Wright et al. | 463/17 |
| 2009/0227320 | A1* | 9/2009 | McBride | 463/17 |
| 2009/0309352 | A1* | 12/2009 | Walker et al. | 283/100 |
| 2010/0267438 | A1* | 10/2010 | Williams et al. | 463/17 |
| 2011/0032078 | A1* | 2/2011 | Guziel et al. | 340/5.86 |
| 2011/0105213 | A1* | 5/2011 | Irwin et al. | 463/17 |

FOREIGN PATENT DOCUMENTS

| | | | |
|---|---|---|---|
| JP | 2005070866 | A | 3/2005 |
| JP | 2008152683 | A | 7/2008 |
| KR | 2003-00006762 | A | 1/2003 |
| WO | WO 2005/001628 | A2 | 1/2005 |

* cited by examiner

LOTTERY GAME APPARATUS INCLUDING THE ACCUMULATION OF PLAYER POINTS

This application claims the benefit of priority under 35 USC 119 of Provisional Application 61/437,444 filed Jan. 28, 2011 and Provisional Application 61/451,392 filed Mar. 10, 2011 and Provisional Application 61/451,403 filed Mar. 10, 2011 and Provisional Application 61/512,262 filed Jul. 27, 2011 by the same Assignee as herein, the disclosures of which are incorporated herein by reference.

This application relates to or is a continuation in part of application Ser. No. 12/783,791 filed May 20, 2010 which corresponds to Canadian Application 2,704,075 filed May 20, 2010.

This application claims the benefit of priority under 35 USC 119 of Provisional Application 61/180,968 filed May 26, 2009.

This invention relates to game apparatus including the accumulation of player points.

BACKGROUND OF THE INVENTION

US Published application 2008/0174068 (York) published Jul. 24, 2008 discloses a method for conducting a lottery that offers players who lose the opportunity to use their losing lottery tickets to enter one or more additional lotteries, a replay program. This proposes that the player will be awarded points which can be used in a second lottery game which can be played on line.

US Published application 2008/0045299 (Bennett) published Jul. 24, 2008 and assigned to Scientific Games discloses a system and method for providing an additional or end-of-game drawing to players of a lottery game. In one embodiment, unique validation codes provided on lottery tickets can be encrypted using an algorithm and used to create a record of such encrypted codes. A player then participates in the lottery and subsequently submits the validation code from the ticket to a lottery provider. The lottery provider applies the algorithm to the submitted validation code to create another encryption code for comparison with the record of encrypted codes. In the event a match is found, the player is entered into a second-chance or end of game drawing.

The above two patent applications relate to participation in second chance draws/lottery style play, which are entered on the internet following purchase of an instant ticket. It appears they are targeted primarily for customers, who did not win, although the losing aspect is more strongly defined in the first application. In both cases, after a player has completed the registration process on their first entry or signed in, if they are pre-registered, they are requested to enter the validation or other ticket identification number and game number as a means of identifying the ticket they are holding. With the second application, the number entered is encrypted and compared to a list of valid numbers from that game and if a match occurs the entry is accepted. For the first application, there is no mention in the claims of a comparison to a supplied list. Once the entry is accepted it is assigned points to be used in subsequent drawings. Points awarded after acceptance of the entry are based on the price of the ticket.

Also in U.S. Pat. No. 7,424,617 of Yahoo there is disclosed a points based system which employs encryption during the entry phase. Points are redeemed for purchases on-line. The example used is for bottle caps.

SUMMARY OF THE INVENTION

It is one object of the invention to provide a lottery game apparatus which provides to the player the opportunity for the accumulation of player points for purposes of enhancing the playing experience.

According to the invention there is provided an apparatus for use in a game to be played by a plurality of players, the apparatus comprising:

a set of tickets;

a programmed computer;

each ticket of the set of lottery tickets comprising:

a substrate having printed thereon, in one or more areas, game data covered by a covering which can be removed by a player to expose the game data;

information on the substrate identifying a number of points awarded to the player in respect of the ticket;

the programmed computer comprising:

a site associated with the tickets;

a program component allowing communication with a player to enter the site from a remote terminal;

a program component allowing entry into a data base of the number of points awarded by the respective ticket;

a program component arranged to maintain an account of a points total held by a player by adding points awarded by the tickets played by that player and deducting points used by the player on the site;

the site including a plurality of games to be played by the player using the points.

Preferably the programmed computer includes information defining, for each of the tickets of the set, the number of points awarded by that respective ticket. In this way the points awarded can be checked by the computer when entered by the player from a ticket. However the system may enter a points awarded from the ticket by an encoded value entered by the player as an entry code or entered automatically by scanning a bar code readable on the ticket.

Preferably the programmed computer includes a program component allowing entry by the registered player of a points entry number from a played ticket.

Preferably the substrate or ticket includes an indication printed for the player of a number of points awarded to the player on that ticket. However this is not essential and the points awarded may only become clear when the player enters the site.

Preferably the exposed game data revealed by removing the covering includes a points entry number identifying the ticket.

Preferably the game data on each ticket defines an instant win game revealing whether the player is a loser or a winner of a prize and if so the value of that prize. Preferably the covering is a scratch-off layer typical with instant win tickets but it can be provided by other types of removable covering. Also the game can be other types of game such as a simple draw, a game of no prize value or even probability type games where the result is determined by the actions of the player.

Preferably the site is a web site and communication through the internet is provided to that site. However the present invention contemplates other forms of communication and that the site has characteristics suitable for that mode of communication.

The games concerned are preferably instant win type games where the result is entirely predetermined, since such games are generally preferred in a lottery situation in order to ensure that the total winnings is predetermined. However the present invention is not limited to the type of game to be played and can include probability or other games which may include game indicia covered by a scratch-off coating.

The construction may also be used in situations where the main objective is for other purposes than gambling such as in promotional games or games of fun for children or others where no gambling or prizes are involved.

Many such tickets are used directly in a lottery situation so that the tickets have no other relevance other than the playing of the lottery or game by which the player may win monetary or other prizes as part of the lottery or gaming situation.

However more attention has been recently given to the use of such tickets as promotional items used by manufacturers of other products to enhance the sale of the product.

The game data including the instant win games and the points information can be located in a single area on the ticket covered by a single scratch-off layer or can be in separate areas in which case they can be covered by the same scratch-off layer or by separate scratch-off layers. The areas can be on the same side or on different sides of the substrate.

Preferably the number of points awarded is independent of the prize.

Preferably points are awarded on both winning and losing tickets.

Preferably the number of points awarded by the tickets is different on different tickets and the number is revealed only on exposing the game data. This makes the points awarded also a part of the game which enhances the player experience even in a situation where the ticket is a losing ticket with no prize awarded.

Preferably the number of points awarded is set out in a Player's Point area, which is part of the game play area and covered by the same scratchoff covering.

Preferably the set of tickets has a published minimum number of points awarded. Thus the player can be assured to win at least a minimum number of points on the ticket with the opportunity by playing the game to win additional points.

In some cases higher points numbers are placed on losing tickets only, while winning tickets are assigned the minimum number of points.

Preferably each of the tickets has printed thereon a validation number for use in entering into a data base to obtain validation of the prize and a points entry number defining the number of points is different from the validation number. In this case the validation number is not stored on nor accessible by the programmed computer. This avoids all the issues of security which can arise if the validation number is used for both functions.

Preferably the programmed computer includes a program component identifying a plurality of different tiers of membership by the registered players and for placing each player in a respective tier of membership. Preferably the tier of membership is selected by the program component based on the number of points added to the account by points awarded from played tickets. Preferably the program component is arranged to provide benefits to the player increasing with each higher membership tier reached.

In this arrangement, the set of tickets can include as a prize thereon an award of memberships to a selected tier independent of the number of points awarded to the player.

In one example of the use of the tiers, different tiers give different points value of the games to be played. For example, if players from two different tiers are playing the same game, the higher tier member may be awarded a higher number of points upon a winning sequence.

The points awarded can preferably be used in different ways. Thus the program can provide the ability for the player to use points from the account to purchase merchandize. Thus the points are used to play the games as on line instant games. Thus the games to be played can require different points value Thus the program can be arranged to provide the ability for the player to use points from the account to cash out. However, as the points are only redeemable at the Player's Club, there is typically no benefit to "cashing out". Points remain stored in the player's account. If the account is inactive for a period of time ie then the points are forfeited.

Thus the program can be arranged to provide the ability for the player to use points from the account to enter a draw.

Thus the program can be arranged to provide the ability for the player to use points from the account to enter an auction, such as a Dutch auction.

Thus the program can be arranged to provide the ability for the player to use points from the account to give to charitable donations.

The program can be arranged to provide the ability for the player to purchase points for the account.

In one example, the indication of the number of points is printed in a separate area, covered by a separate scratchoff area. In this case, the ticket can be separated into a main portion and a stub portion joined to the main portion and separable therefrom by a perforation and the indication of the number of points is printed is printed on the stub.

In addition the ticket can have printed thereon a code that can be scanned by a mobile device for automatic access web site.

This concept as described in more detail hereinafter is distinct from the above identified patent applications because of the following:

The present concept requires a separate code to enter not the validation number.

The present concept eliminates need to encrypt validation number

The present concept preferably makes the Players Club available to all players regardless of status after instant play.

In the present concept points are pre-assigned to the lottery ticket and are variable. Entry process simply verifies the previously assigned value versus assigning a value after entry process.

In the present concept the accumulation of points leads to attaining a certain membership level with benefits increasing with each higher membership level reached.

The use of a separate Player's Club number eliminates the need for encryption. The use of the separate Player's Club number, while it may be linked algorithmically to the validation number in the secret situation of the printer, does not pose the security risks associated with the use of the validation number because there is no relationship between the instant prizing on the ticket and the Player's Club points being awarded on a particular ticket. The Player's Club number remains completely hidden from view until such time as the scratchoff covering is removed. No portion of the number is visible prior to play by the consumer. The validation number or, at a minimum, a subset of the validation number is also covered prior to removal by the player. Lotteries are very sensitive to access to the validation information and the potential loss of integrity if this knowledge were to become public. High levels of security surround this information. In the previous systems, all numbers must be encrypted to avoid the risk of having a file of losing validation numbers resident on a separate system from the lottery validation system.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
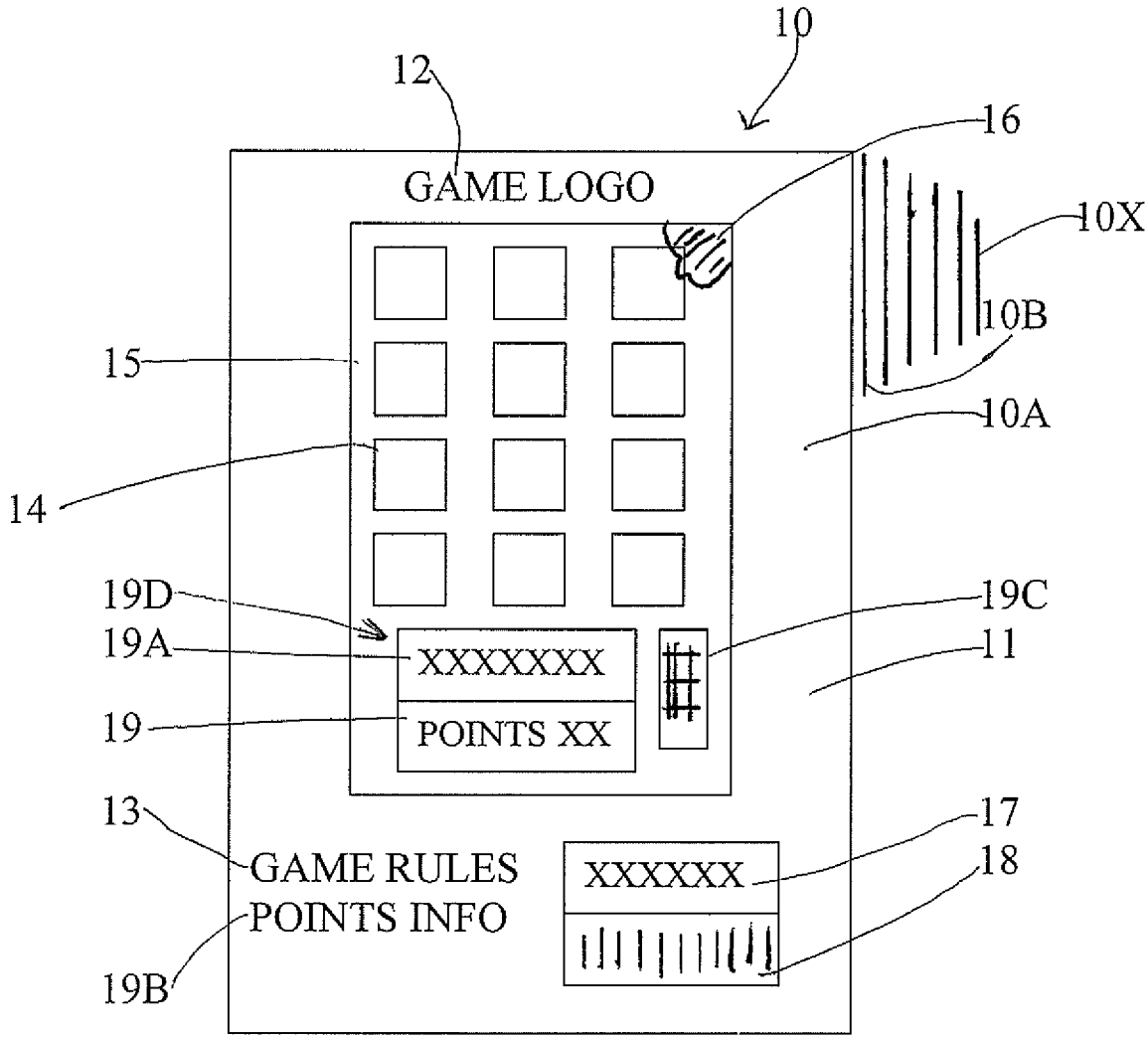
FIG. 1 is a plan view of a lottery ticket forming one part of an apparatus according to the present invention.
Figure 2:
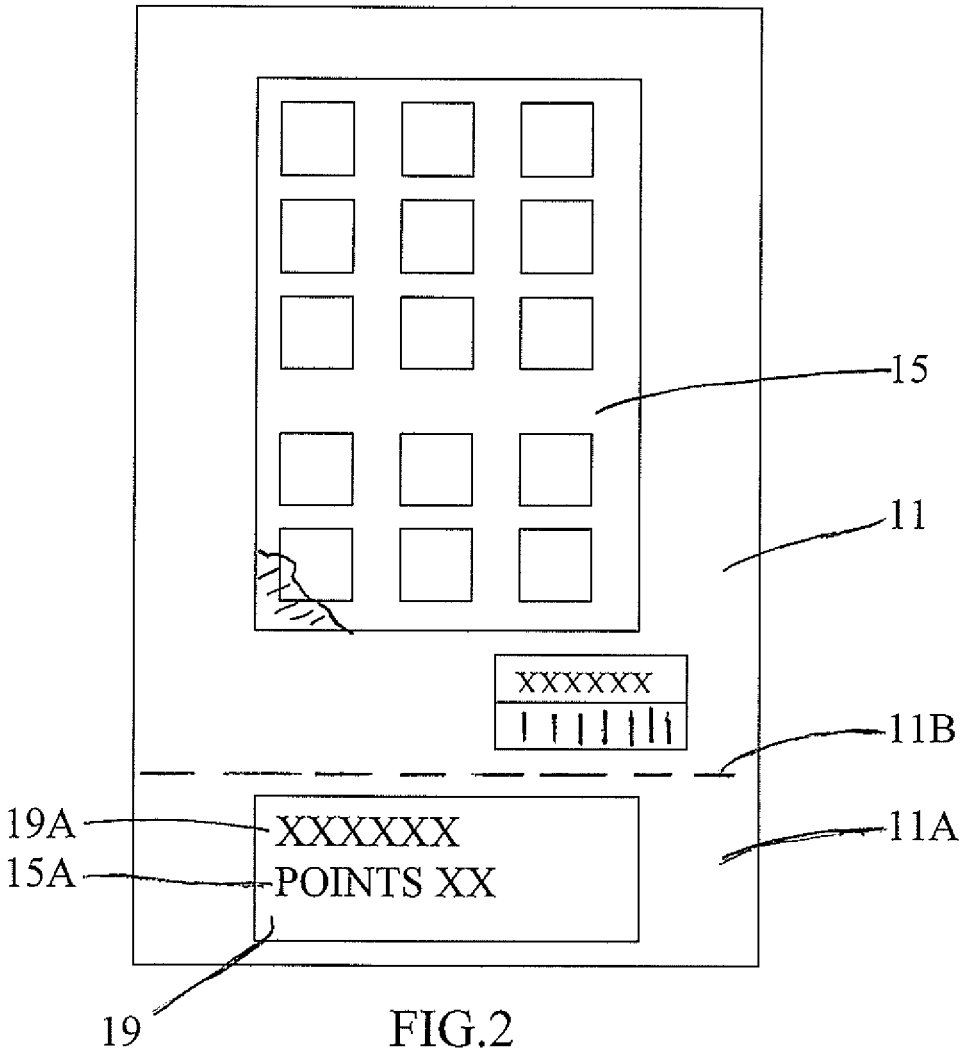
FIG. 2 is a plan view of a second embodiment of lottery ticket forming one part of an apparatus according to the present invention.
Figure 3:
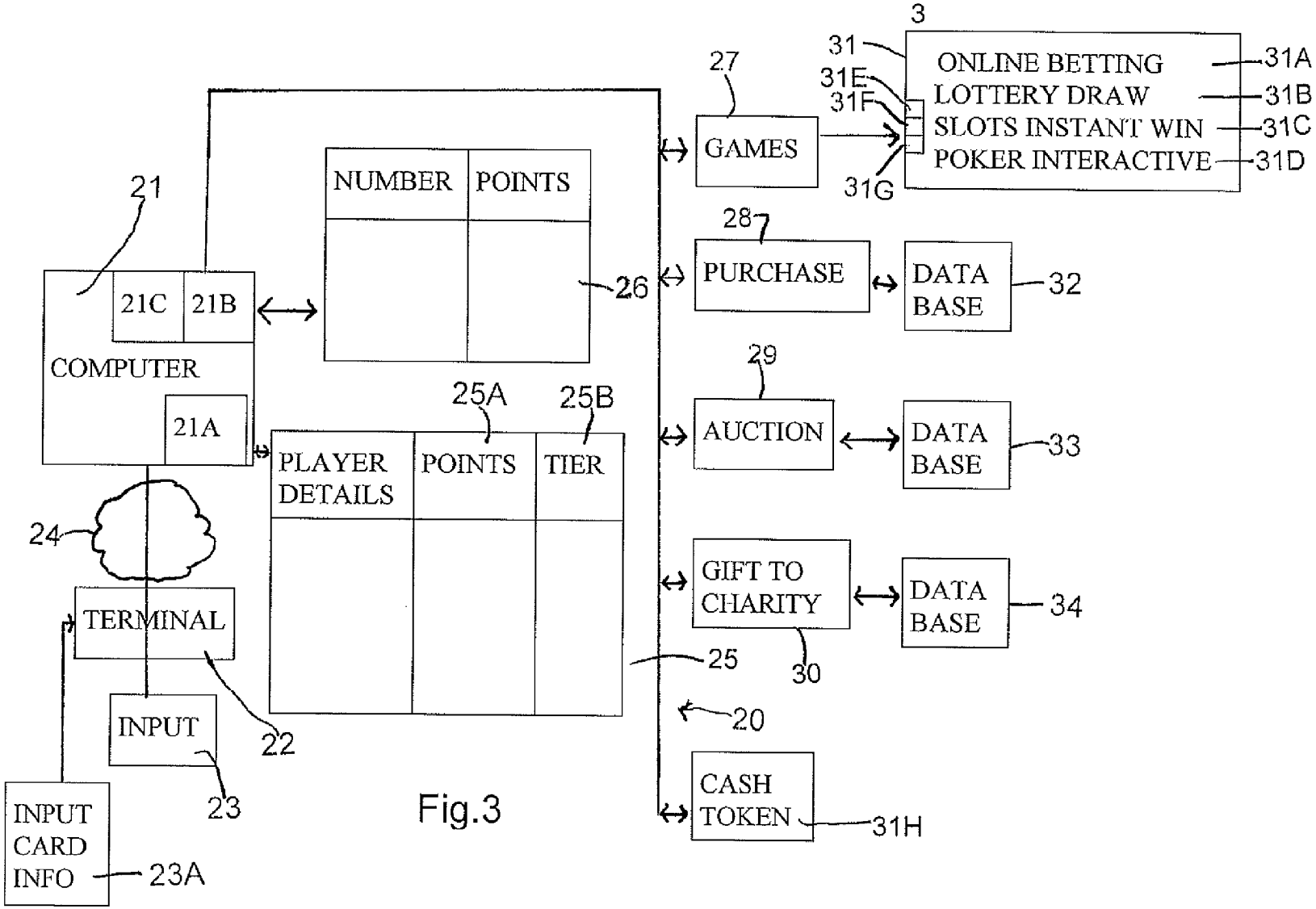
FIG. 3 is a schematic illustration of a computer system forming a second part of an apparatus according to the present invention.

The apparatus shown in FIGS. 1 to 3 for use in a lottery game to be played by a plurality of players includes a set of lottery tickets 10 shown in FIG. 1 and a programmed computer system 20 shown in FIG. 3.

The set of lottery tickets includes a plurality of individual tickets 10A, 10B to 10X. The number of tickets can vary but typically the tickets are formed in books making up a complete set for a particular game. The books are provided as individual items to be sold by retailers to the public. Depending on the longevity of the game, the number of books can be large with many re-printings or can be much smaller for specific dedicated games.

Each ticket is formed of a substrate having printed thereon various information necessary for the game to be played. This includes a game logo 12 and game rules 13 which set out the basis by which the winning and losing status of the ticket is instantly determined from game data 14 including a level of prize for a winning ticket. Many different arrangements for such instant win tickets are well known to a person skilled in the art.

The game data 14 is printed in a game area 15 using printing techniques well known to a person skilled in the art and is covered by a scratch-off layer 16 also well known.

The ticket further includes a validation number 17 and a bar code 18 related to the validation number allowing these to be used to validate any prize claimed by a player after playing the game by exposing the game data. The bar code and validation number can left exposed or be covered before playing by a second area of scratch-off or by the same area 16. If the barcode and validation number are exposed then the validation number is incomplete. To ensure security some of the digits from the validation number are hidden from view under scratchoff. If a barcode is hidden then it would contain all of the necessary data to complete the validation process.

The game data 14 is thus covered by an areas of scratch-off coating 16 which can be removed by a player to expose the game data with the exposed game data including an instant win game revealing whether the player is a winner of a prize and if so the value of that prize.

In addition to the conventional instant win game, the area 15 includes, when exposed by removal of the layer 16, an indication 19 of a number of points awarded to the player printed in a person readable number. The information printed further includes in the exposed game data points entry number 19A as a unique number identifying the ticket.

The number of points awarded by the ticket is thus readable when exposed with the points entry number identifying that ticket also being readable for entry into a computer as explained hereinafter. At 19B the ticket includes information related to the rules for the awarding of points including a minimum number always awarded and other "prize" amounts which exceed the minimum.

A code 19C is also printed onto the ticket in the game area which can be read and decoded using a mobile phone or similar camera device which allow the code to be entered into a program for decoding either on the device or remotely.

As shown in FIG. 3, the system 20 includes a programmed computer 21 which forms a server which allows access to a web site by the player of the ticket from a terminal 22. The web site is associated with the tickets in that the points entry numbers 19A or the code 19C when entered into an input 23 allow access by the player into the web site.

The computer 21 communicates through the internet 24 with a player at the remote terminal 22 wishing to enter the web site.

The computer 21 includes a program component 21A for entering registration of personal details of a player entering the web site and for storing data identifying each player in a data base 25.

The computer 21 includes a program component 21B allowing entry by the registered player of a points entry number from a played ticket with that information being stored in a data base 26. The data base 26 contains information defining, for each of the tickets of the set, the number of points awarded by that respective ticket as identified by the respective points entry number.

The program 21A is arranged to maintain in the data base 25 for each registered player an account of a points total held by that player by adding points awarded by the tickets played by that player and deducting points used by the player on that web site. The data base also contains information defining a tier of player associated with each of the players.

The computer defines for the web site series of available locations where the player can access. These includes a plurality of games 27 to be played by the player using the points, a purchase program 28 by which the player can use the points to make purchases, an auction program by which the player may use the points to enter an auction and a gift to charity program by which the player can use the points to dedicate points or their cash value to charity. These programs are associated with data bases 31, 32, 33 and 34 respectively containing the necessary information to allow the transactions to occur. The data base 31 includes various games to be played including online betting 31A, a lottery draw 31B, slot type instant win games 31C, spin the wheel and poker type interactive games 31D.

The terminal 22 includes a further input 23A which allows a player to input a payment sum. This can be done by credit card or more preferably is done by purchasing a pre-paid card from a lottery retailer which carries a payment amount and codes which allow the payment to be processed.

In FIG. 2, instead of the points information being printed in the area 15 with the game data, it is printed in a separate area 15A located at a separate location on the substrate. In this case the area 15A is located on a stub portion 11A of the ticket which can be separated by a line of perforations 11B. In this way the game part of the ticket can be separated from the points part for separate processing depending on whether the game part is a winning or losing ticket.

The Player's Club disclosed herein operates as follows:

The number of points awarded on the points total 19 as established by the points entry number 19A is independent of the prize.

Points 19 are awarded on both winning and losing tickets.

The number of points 19 awarded by the tickets is different on different tickets 10A, 10B etc and the number is revealed only on exposing the game data by the player removing the scratch-off layer 16.

The number of points 19 awarded is set out in a Player's Point area 19D, which is part of the game play area 15 and covered by the same scratchoff covering 16.

The set of tickets 10 has a published minimum number of points awarded as set out in the points information 19B.

Higher points numbers are placed on losing tickets only, while winning tickets are assigned the minimum number of points.

Each of the tickets 10A etc has printed thereon a validation number 17 for use in entering into a data base to obtain validation of the prize and the points entry number 19A is different from the validation number and the validation number is not stored on nor accessible by the programmed computer 21.

The programmed computer includes a program component 21A identifying a plurality of different tiers of membership 25B by the registered players and for placing each player in a respective tier of membership.

The tier of membership 25B is selected by the program component 21A based on the number of points added to the account by points 25A awarded from played tickets. The program component 21A is arranged to provide benefits to the player increasing with each higher membership tier reached.

The set of tickets 10 includes on one or more of the tickets of the set as a prize thereon from playing the game data 14 an award of memberships to a selected tier 25B independent of the number of points 25A awarded to the player.

The games 31 are arranged to give different tiers of player give different points value of the games to be played.

The program 21C provides the ability for the player to use points from the account to purchase merchandize as indicated at program 28.

The games 31C to be played are on line instant games.

The games 31C to be played require different points value 31E, 31F and 31G.

The program 21C provides the ability for the player to use points from the account to cash out by selecting a program 31H to provide a token to be printed out and redeemed at the lottery retailer.

The program 21C provides the ability for the player to use points from the account to enter a draw 31B.

The program provides the ability for the player to use points from the account to enter an auction using program 29.

The program provides the ability for the player to use points from the account to give to charitable donations using program 30.

The program provides the ability for the player to purchase points for the account 25A by entering a monetary payment at input 23A.

The program provides the ability for the player to purchase points for the account. In this case, payment can be made by credit or other type of transactional card input.

The program provides the option of purchasing points from a lottery retailer who upon completion of the transaction will provide the player with a coupon for entry onto the player's club website. In this case, the coupon contains a barcode to facilitate the process either via a computer terminal with attached scanner or a similarly equipped mobile device.

The points can be awarded as an incentive for different actions undertaken by a player. For example a player can earn bonus points if they use a mobile device to scan the entry code.

The Player's Club is a point-based operation in which player's earn points through the purchase of instant tickets and then utilize these points to purchase lottery merchandise or participate in other forms of gaming to extend their play including promotions, drawings, etc.

Optionally the lottery may introduce multiple tiers (ie. bronze, silver, gold, etc.) which a player can achieve through the accumulation of points in order to reach pre-determined entry point levels. The various levels may provide different types of gaming/offerings in order to act as an incentive for players to accumulate enough points to achieve the next tier.

An alternate way to achieve membership would be for the lottery to award high level prizes of instant memberships to these tiers, which bypasses the accumulated points levels normally required. Frequency of this type of win would be at the lottery's discretion.

One of the key features is that every ticket in a lottery game, whether it is a winner or loser on the instant portion, will be a winner on the Player's Club side. Every ticket is considered a winner because every player will receive at least the minimum level of points when the ticket is scratched regardless of the win/lose status on the main play area(s). Optionally the lottery could restrict the assignment of points to losing tickets only.

At the time of play as the player is removing the scratchoff from the game areas on the ticket, preferably they will find a Player's Point area, which will be part of the game play area and covered by the same scratchoff covering. The Player's Point area will contain the numeric value of points won on that ticket. Associated with the Player's Point value will be a multi-digit number or optionally will be alphanumeric. This number is preferably unique within the game and different than the validation number used for redemption of the instant portion. In addition to the Player's Club entry number the game number may be associated with it or the player would be required to enter the game number from the back of the ticket.

Alternatively the Player's Point value and entry number could be positioned in a separate box, covered by a separate scratchoff covering. Another option would be the placement of the Player's Point information in a separate box which shares the scratchoff covering with the game play area. A further option would be to place the Player's Points information on the back of the ticket covered by a scratchable coating. Another option would be to place the Player's Points information in a separate box, covered by a separate scratchoff, on a stub. The stub would be joined to the ticket and separable by a perforation so that the player would be able to retain the information even if the ticket is a winner or does not need to retain the entire ticket in the case of a loser.

In addition to or independent of, the above, the Player's Point value and entry number could be contained in a code, such as a QR code, data matrix barcode or other type of code, that could be scanned by a mobile device for automatic access to the Player's Club and expedited entry and point accumulation. Also points could be awarded as an incentive for different actions undertaken by a player. For example a player could earn bonus points if they use a mobile device to scan the entry code.

In the case where a common game area and covering is used caution would have to be taken to clearly identify the Player's Points value so that a player cannot claim a winner when, for example, the points value matches the Numbers to Match number in the instant game.

The use of a separate Player's Club number eliminates the need for encryption. The use of the separate Player's Club number, while it may be linked algorithmically to the validation number in a manner secretly available to the printer only, does not pose the security risks associated with the use of the validation number because no portion of the number is visible prior to play by the consumer. In the other systems all numbers must be encrypted to avoid the risk of having a file of losing validation numbers resident on a separate system from the lottery validation system.

The majority of tickets, winners and losers produced will have a minimum value of points the level for which is established by the lottery prior to ticket production. If additional playability is desired the points values on some tickets can be raised. The higher value of points will preferably appear on both winning and losing tickets so that if an individual were to access the file they could not differentiate between a winner and loser on the regular game portion. Even with access to the file the security of the ticket is protected by the covering of the complete entry number by scratchoff. Optionally the higher points values would be placed on losing tickets only while winning tickets would be assigned the minimum level(s) of points.

Point values may be based on the price point of the ticket with tickets having a higher price point being assigned a correspondingly higher minimum points value and possibly a higher overall range of point values. Point ranges could vary between different lottery organizations.

The first step in the process will be for the player to register as a member of the Player's Club. This can be done either in advance of an entry or at the same time as the initial entry. Registration would include the type of information commonly retained—name, address, contact information, etc. Once the registration process is complete, including establishment of a password, etc. the player can begin the entry process for tickets which they have accrued. Data entry will consist of game and ticket identification. A further check would be the entry of the point value shown on the ticket. The system would then check the information and point value and compare it to the file for that game, which is supplied by the ticket manufacturer. If the match is made then the points will be credited to the player's account.

For subsequent visits, the player will log onto to the system and once verified they can begin the process of entering ticket info. The points value for each accepted ticket is added to the player's account.

Once the player has accumulated enough points they would have a choice of options as to how they spend the points earned. There will be a potentially broad range of options available and the variety can be expanded and adjusted over time. Prizes for the different options will vary. The player could play to earn additional points, eg. by playing a slot machine, participate in lotto draws, eg. selecting a subset of numbers from a range of available numbers—Pick 3 (1 combination of 3 numbers out of a possible 1000), enter draws for prizes (merchandise, cash, instant lottery ticket coupons redeemable for tickets, play on-line gaming either for fun or additional prizes, etc. There is a wide range of possible activities which can be implemented initially or can be added over time to maintain high levels of interest and participation.

In addition players would have the opportunity to "spend" their points in order to purchase items. Items could include merchandise, coupons for instant tickets, movie passes, etc.

Following are a list of possible concepts that can be used. For example the player can:

Enter the Casino

The casino would offer various play formats including slot machines. There would be different levels of slots available. Entry would be based on pre-determined numbers of points per play (for example, 1 pt, 5 pt, 10 pt, 20 pt, 50 pt. etc.). Play action would be similar to a standard slot machine and would offer, free plays, accumulating points credits and even cash or merchandise prizes. The variety of games available to a Player's Club member may change depending on the tier level they are at. For example, slot machine at the silver level may include the 20 pt. machines in addition to those at the lower levels. At the gold level the 50 pt. machines would be added.

Players could cash out at any time and their accumulated points (if any) would be credited to their account. The player could redeem these points at the internet lottery store for gift packs, movie passes, etc.

Lottery Draws

For x points the player could enter into draws for various lottery items or cash/merchandise prizes. Draws cannot be related to a specific game—see note below.

In the case of the tiered membership structure, higher membership levels would have access to more/better draws than base level members.

Virtual Prize Wheel

For x points, the Player's Club member can spin a virtual wheel for a chance to win in a variety of different prize categories. For example they could spin to multiply their accumulated points by some factor. For example, the values on the wheel could range from 1 to 1,000. Alternatively prizes could include a chance to win automatic entries into every 2nd chance draw conducted by the lottery for a predetermined period of time, predetermined number of draws or continuous.

Enter Auction

The auction is an auction house where players could bid to win prizes or packs being offered by the lottery. Unlike Ebay, LBay would be based on a Dutch auction style in which the points required to purchase decrement until such time as a Player agrees to pay the required number of points in order to obtain the reward. Typically a multiple of the same item (ie. 20 lottery packs) is offered and even after 1 or more units is bought at a particular points level, the required points level would continue to decline until all offered are sold or there are no takers even at the lowest amount.

If multiple bids are received at the same points level which exceeds the number of items being offered then the earliest bids win. We may want to consider allowing for pre-bids—a player submit a bid of x points well in advance of reaching that level or even in advance of the start of the auction. If the auction reaches that level then the player's bid is automatically entered. This might deflect concern that people have to have access to a computer at all times and the need to monitor the action.

Charitable Donations

Players could donate a portion of their accumulated points to a list of charitable organizations within the state. For example charitable organizations could submit requests for support and a cost associated with the support being sought (animal shelter requesting x dog kennels at a cost of $1,000 per). The lottery would assign a point level required to provide the items and players would select an organization and donate points accordingly.

The lottery might even consider allowing organizations (ie. service clubs) to collect tickets or entry data (in the case of winning tickets) from it's members and to apply these points to the items they are seeking to obtain.

Accumulate Points by Scanning Codes on Tickets with a Mobile Device/Smart Phone. Offer special promotions on select games that feature QR codes or other types of codes. Player would scan the code with their mobile device for automatic access to the lottery website or Player's Club. Points could be earned initially to encourage the use of this technology.

Points for Presents

Points could be used to purchase gifts during the holidays. Selection of gifts could include lottery merchandise, lottery subscriptions, instant tickets, etc. For an additional fee, the gifts would be delivered directly to the intended recipient.

There are a variety of different options that could be made available and this could be increased in order to maintain and build player participation.

The invention claimed is:

1. A system for managing a lottery comprising:

a set of physical instant win lottery tickets for a lottery game of the lottery configured to be sold to customers for dispensing of lottery funds to said customers, wherein each ticket of the set of physical instant win tickets comprises (i) a substrate having printed thereon, in one or more areas, game data covered by a covering which can be removed to expose said game data to provide a status of said lottery game which is either a winning status with a prize or a losing status; (ii) the substrate having printed thereon, different from and additional to the game status, information defining a number of reward points associated with said ticket, the number of reward points associated with said ticket is different than the number of reward points associated with another ticket of said series of physical instant win lottery tickets;

a first computer based apparatus for validation and redemption at a retailer location of tickets of said set of physical instant win tickets having a winning status, the first computer apparatus having a database containing all of said tickets having a winning status to facilitate validation and redemption;

wherein said set of physical instant win lottery tickets are configured such that some of said tickets are sold to customers and those sold tickets having a winning status have the validation and redemption thereof carried out by the first computer apparatus using the database while remaining tickets of said tickets having a winning status remain unsold;

a second computer based apparatus providing a website associated to the lottery game;

wherein each of said tickets has material printed thereon identifying at least the website related to the lottery;

wherein said material is arranged so that it is able to be analyzed from an image thereof taken of a respective ticket of said tickets on a camera module of a personal communication device to generate information identifying at least the website associated to the lottery game;

wherein said material on the respective ticket and the second computer based apparatus is configured such that, when information identifying at least the website is communicated to the second computer based apparatus, the second computer based apparatus enables communication between the personal communication device and the website in order to communicate data from the website to the personal communication device;

wherein the second computer apparatus maintains a database of reward points associated with each ticket of the set of physical instant win lottery tickets;

wherein the second computer apparatus is configured to register an account for one or more of said customers, thereby maintaining accounts for registered customers that include an accumulation of a total number of reward points associated with one or more respective tickets; and wherein the second computer apparatus is configured to allow said registered customers to use their respective accumulated reward points, via the website, such that each player's respective accumulated reward points are increased by adding reward points associated with respective tickets provided to the second computer apparatus and are decreased by deducting reward points used by the registered customer.

2. The system according to claim 1 wherein the number of reward points awarded is printed in a Point area, which is part of the said game data and covered by said covering.

3. The system according to claim 1 wherein each of the set of physical instant win lottery tickets has at least a minimum number of reward points awarded which minimum number is published in association with the set.

4. The system according to claim 3 wherein higher reward points numbers are associated with said tickets having said losing status while said minimum number of reward points is associated with said tickets having a winning status.

5. The system according to claim 1 wherein each of said physical instant win lottery tickets has printed thereon a validation number for use in entering into the first computer based apparatus to obtain validation of the prize and wherein each of said physical instant win lottery tickets has printed thereon a reward points entry number having associated therewith a number of reward points, wherein the reward points entry number is different from the validation number, and wherein the validation number is not stored on nor accessible by the second computer based apparatus.

6. The system according to claim 1 wherein the second computer based apparatus is configured to identify a plurality of different tiers of membership by registered customers and for placing each registered customer in a respective tier of membership.

7. The system according to claim 6 wherein the tier of membership for each respective registered customer is determined by the second computer based apparatus based on the respective register customer's total accumulation of reward points added to their account by reward points awarded from played tickets.

8. The system according to claim 6 wherein the second computer based apparatus is arranged to provide benefits to the registered customer increasing with each higher membership tier reached.

9. The system according to claim 6 wherein the set of physical instant win lottery tickets includes as prizes thereon an award of memberships to a selected tier independent of the number of reward points awarded to the registered customer.

10. The system according to claim 6 wherein the second computer based apparatus is configured to provide a plurality of games, wherein reward points are used to play said plurality of games, and wherein the different membership tiers enable games to be played on the second computer based apparatus which are of different values of rewards points.

11. The system according to claim 10 wherein the plurality of games to be played are on line instant games.

12. The system according to claim 11 wherein at least some of the plurality of games to be played require a value of rewards points which is different from that of other games of the plurality of games.

13. The system according to claim 1 wherein the second computer based apparatus is configured to allow a registered customer to use the accumulated reward points in their respective account to cash out.

14. The system according to claim 1 wherein the second computer based apparatus is configured to allow the registered customer to purchase reward points for their account.

15. The system according to claim 1 wherein the second computer based apparatus is configured to allow the option of purchasing reward points from a lottery retailer who, upon completion of the transaction, will provide a registered customer with a coupon for entry of the purchased reward points onto the account of the registered customer on the website.

16. The system according to claim 15 wherein the coupon contains a barcode to facilitate adding the points to the account of the registered customer either via a computer terminal with an attached scanner or said personal communication device using said camera module.

17. The system according to claim 1 wherein each ticket is separated into a main portion and a stub portion joined to the main portion and separable therefrom by a perforation and wherein said information defining the number of reward points associated with said ticket is printed on the stub portion.

18. The system according to claim 17 wherein the second computer based apparatus is configured to allow the registered customer to earn bonus reward points if they use said personal communication device and said camera module to scan the barcode.

19. The system according to claim 1 wherein the second computer based apparatus is configured to allow a registered customer to use the accumulated reward points in their respective account to enter an auction.

20. The system according to claim 1 wherein the second computer based apparatus is configured to allow a registered customer to use the accumulated reward points in their respective account to give to charitable donations.

21. The system according to claim 1 wherein the second computer based apparatus is configured to allow a registered customer to use the accumulated reward points in their respective account to purchase merchandise.

* * * * *